US010895389B2

(12) United States Patent
Abe et al.

(10) Patent No.: US 10,895,389 B2
(45) Date of Patent: Jan. 19, 2021

(54) AIR-CONDITIONING APPARATUS

(71) Applicant: Mitsubishi Electric Corporation, Tokyo (JP)

(72) Inventors: Daisuke Abe, Tokyo (JP); Jun Someya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/075,196

(22) PCT Filed: Apr. 7, 2016

(86) PCT No.: PCT/JP2016/061360
§ 371 (c)(1),
(2) Date: Aug. 3, 2018

(87) PCT Pub. No.: WO2017/175345
PCT Pub. Date: Oct. 12, 2017

(65) Prior Publication Data

US 2019/0041070 A1 Feb. 7, 2019

(51) Int. Cl.
*F24F 1/24* (2011.01)
*F25B 31/00* (2006.01)
*F24F 1/22* (2011.01)

(52) U.S. Cl.
CPC ..... *F24F 1/24* (2013.01); *F24F 1/22* (2013.01); *F25B 31/006* (2013.01)

(58) Field of Classification Search
CPC ..... F24F 1/24; F24F 1/22; F25B 31/006
(Continued)

(56) References Cited

U.S. PATENT DOCUMENTS 2,978,881 A * 4/1961 Alsing ..... F25B 31/006 62/324.6
4,505,118 A * 3/1985 Altman ..... A61M 19/00 62/3.2

(Continued)

FOREIGN PATENT DOCUMENTS

CN 102713462 A 10/2012
JP H01-139942 A 6/1989

(Continued)

OTHER PUBLICATIONS

International Search Report of the International Searching Authority dated Jun. 7, 2016 for the corresponding International application No. PCT/JP2016/061360 (and English translation).

(Continued)

*Primary Examiner* — Paul Alvare
*Assistant Examiner* — Kristin U Oswald
(74) *Attorney, Agent, or Firm* — Posz Law Group, PLC

(57) ABSTRACT

An air-conditioning apparatus includes a refrigerant circuit in which a compressor, a first heat exchanger, an expansion unit, a second heat exchanger, and a first cooling unit having a refrigerant path are connected to each other by a pipe and through which refrigerant flows, a controller configured to control operation of the compressor and having a heat-generating element, a heat transfer element having a proximal end connected to the heat-generating element and a distal end connected to the first cooling unit, and conveying heat generated by the heat-generating element, and a second cooling unit connected between the proximal end and the distal end of the heat transfer element and cooling the heat transfer element, and the first cooling unit cools the heat transfer element using the refrigerant.

9 Claims, 4 Drawing Sheets

(58) Field of Classification Search
USPC ..... 62/498
See application file for complete search history.

(56) References Cited

U.S. PATENT DOCUMENTS

| | | | | |
|---|---|---|---|---|
| 4,720,981 | A * | 1/1988 | Helt | F25B 40/00 165/80.4 |
| 5,964,279 | A * | 10/1999 | Mochizuki | F28D 15/0233 165/104.33 |
| 6,288,895 | B1 * | 9/2001 | Bhatia | G06F 1/203 165/104.33 |
| 6,668,569 | B1 * | 12/2003 | Jin | F25B 13/00 62/197 |
| 2004/0003607 | A1 * | 1/2004 | Kadle | B60H 1/00885 62/158 |
| 2004/0206110 | A1 * | 10/2004 | Lifson | F25B 41/04 62/498 |
| 2008/0289345 | A1 * | 11/2008 | Nejad | F25B 49/022 62/117 |
| 2010/0132399 | A1 * | 6/2010 | Mitra | B60H 1/3228 62/498 |
| 2010/0319883 | A1 * | 12/2010 | Facusse | H05K 7/20818 165/104.26 |
| 2012/0198859 | A1 * | 8/2012 | Sepulveda | F28D 15/0275 62/3.1 |
| 2012/0279251 | A1 * | 11/2012 | Kido | F25B 31/006 62/498 |
| 2014/0326437 | A1 | 11/2014 | Kamitani et al. | |
| 2015/0271949 | A1 * | 9/2015 | Kim | H05K 7/2039 361/699 |
| 2016/0320077 | A1 * | 11/2016 | Kim | F24F 1/24 |
| 2017/0234553 | A1 * | 8/2017 | Han | F25B 41/04 62/259.2 |

FOREIGN PATENT DOCUMENTS

| | | | | |
|---|---|---|---|---|
| JP | H04-368156 | A | | 12/1992 |
| JP | H06-101913 | A | | 4/1994 |
| JP | 2000-234767 | A | | 8/2000 |
| JP | 2000234767 | A | * | 8/2000 |
| JP | 2005-331141 | A | | 12/2005 |
| JP | 2011-099577 | A | | 5/2011 |
| JP | 2012-059895 | A | | 3/2012 |
| JP | 2013-076478 | A | | 4/2013 |
| JP | 2014-085055 | A | | 5/2014 |
| JP | 2015-148355 | A | | 8/2015 |
| JP | 2015148355 | A | * | 8/2015 |
| WO | 2011/083756 | A1 | | 7/2011 |

OTHER PUBLICATIONS

Office Action dated Jun. 25, 2019 issued in corresponding JP patent application No. 2018-510182 (and English translation).
Office Action dated Jan. 14, 2020 issued in corresponding JP patent application No. 2018-510182 (and English translation).
Office Action dated Feb. 3, 2020 issued in corresponding CN patent application No. 201680084118.4 (and English translation).
Office Action dated Aug. 26, 2020 issued in corresponding CN patent application No. 201680084118.4 (and English translation).

* cited by examiner

AIR-CONDITIONING APPARATUS

CROSS REFERENCE TO RELATED APPLICATION

This application is a U.S. national stage application of International Application No. PCT/JP2016/061360, filed on Apr. 7, 2016, the contents of which are incorporated herein by reference.

TECHNICAL FIELD

The present invention relates to an air-conditioning apparatus that cools a heat-generating element provided in a controller.

BACKGROUND

A board, an electrical component, and other components for controlling operation of a conventional air-conditioning apparatus are housed in an electric component box and provided in an outdoor unit. By being housed in the electric component box, the board, the electrical component, and other components are inhibited from being exposed to rainwater or other material entering the outdoor unit through an air inlet, an air outlet, and other part provided in the outdoor unit. The electrical component that is a heat-generating element that generates a large amount of heat such as a power module is cooled to inhibit thermal destruction. An example of a system for cooling the heat-generating element is an air cooling system. In the air cooling system, for example, a large-sized heat sink or other similar device is attached to the heat-generating element, and thus an amount of heat rejected from the electrical component is ensured. The heat sink is installed in an air passage formed between the air inlet and the air outlet. The heat sink is cooled by air flowing through the air passage, and the cooled heat sink cools the electrical component. In the air cooling system, when an amount of heat generated is increased, the heat sink needs to be increased in size. Thus, the amount of metallic material to be used and required for producing the heat sink is increased, so that the production cost for the air-conditioning apparatus is increased.

Patent Literature 1 discloses an air-conditioning apparatus that employs a refrigerant cooling system as well as an air cooling system as a system for cooling a heat-generating element. In Patent Literature 1, a refrigerant pipe of a refrigerant circuit and a power board housed in an electrical component box are joined to each other with a refrigerant jacket interposed between the refrigerant pipe and the power board, and the temperature of refrigerant flowing through the refrigerant pipe is controlled to be lower than the temperature of the power board. Then, heat generated by the power board is rejected to the refrigerant, and thus the power board is cooled. As described, Patent Literature 1 is intended to inhibit the temperature of the power board from rising.

PATENT LITERATURE

Patent Literature 1: Japanese Unexamined Patent Application Publication No. 2011-99577

However, in the air-conditioning apparatus disclosed in Patent Literature 1, as heat generated by the heat-generating element is rejected to the refrigerant, the refrigerant is heated. Thus, for example, during cooling operation, cooling capacity for cooling an air-conditioned space is decreased. Consequently, the operating efficiency of the air-conditioning apparatus decreases.

SUMMARY

The present invention has been made to solve the above-described problem, and provides an air-conditioning apparatus that rejects heat generated by a heat-generating element, while inhibiting a decrease in operating efficiency.

An air-conditioning apparatus according to an embodiment of the present invention includes a refrigerant circuit in which a compressor, a first heat exchanger, an expansion unit, a second heat exchanger, and a first cooling unit having a refrigerant path are connected to each other by a pipe and through which refrigerant flows, a controller configured to control operation of the compressor and having a heat-generating element, a heat transfer element having a proximal end connected to the heat-generating element and a distal end connected to the first cooling unit, and conveying heat generated by the heat-generating element, and a second cooling unit connected between the proximal end and the distal end of the heat transfer element and cooling the heat transfer element, and the first cooling unit cools the heat transfer element using the refrigerant.

According to an embodiment of the present invention, the heat transfer element that conveys the heat generated by the heat-generating element is cooled by the second cooling unit earlier than by the first cooling unit cooling heat using the refrigerant. Thus, a load on the first cooling unit for cooling the heat-generating element is reduced. Consequently, the air-conditioning apparatus is capable of rejecting heat generated by the heat-generating element while inhibiting a decrease in operating efficiency.

DETAILED DESCRIPTION

Embodiment 1

Figure 1:
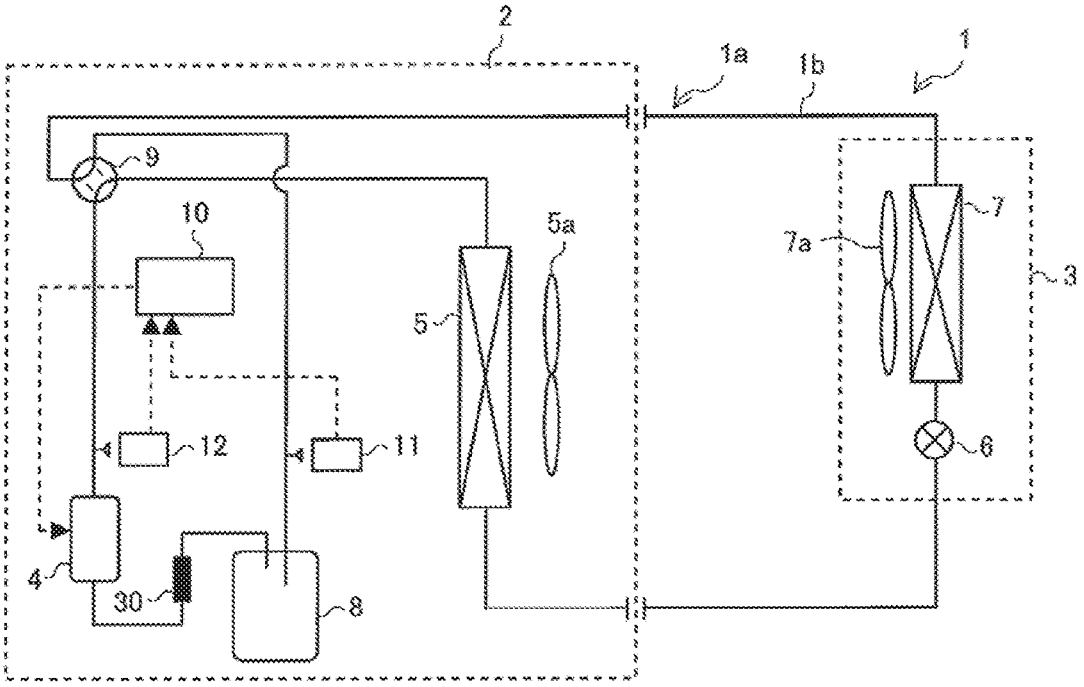
FIG. 1 is a circuit diagram showing an air-conditioning apparatus 1 according to Embodiment 1 of the present invention.

Hereinafter, an air-conditioning apparatus according to Embodiment 1 of the present invention will be described with reference to the drawings. FIG. 1 is a circuit diagram showing an air-conditioning apparatus 1 according to Embodiment 1 of the present invention. The air-conditioning apparatus 1 will be described with reference to FIG. 1. As shown in FIG. 1, the air-conditioning apparatus 1 includes an outdoor unit 2 and an indoor unit 3. The outdoor unit 2 is installed outdoor and has a compressor 4, a flow path switching unit 9, a first heat exchanger 5, a first cooling unit 30, an outdoor fan 5*a*, an accumulator 8, a suction pressure sensor 11, a discharge pressure sensor 12, and a controller 10. The indoor unit 3 is installed in an indoor space and has an expansion unit 6, a second heat exchanger 7, and an indoor fan 7*a*. The compressor 4, the flow path switching unit 9, the first heat exchanger 5, the expansion unit 6, the second heat exchanger 7, the accumulator 8, and the first cooling unit 30 are connected to each other by a pipe 1*b* to form a refrigerant circuit 1*a* through which refrigerant flows.

The compressor 4 compresses the refrigerant. The flow path switching unit 9 switches directions in which the refrigerant flows through the refrigerant circuit 1*a*. The flow path switching unit 9 switches whether the refrigerant discharged from the compressor 4 flows to the first heat exchanger 5 or the second heat exchanger 7. With this operation, any of cooling operation or heating operation is performed. The first heat exchanger 5 allows heat exchange between outdoor air and the refrigerant, for example. The outdoor fan 5*a* sends outdoor air to the first heat exchanger 5. The expansion unit 6 expands the refrigerant and reduces the pressure of the refrigerant, and is, for example, an electromagnetic expansion valve having an adjustable opening degree. The second heat exchanger 7 allows heat exchange between indoor air and the refrigerant, for example. The indoor fan 7*a* sends indoor air to the second heat exchanger 7. The accumulator 8 stores the refrigerant in a liquid state. The first cooling unit 30 has a refrigerant flow path and cools a cooled target.

The suction pressure sensor 11 is provided at the inflow side of the accumulator 8 and measures the pressure of the refrigerant sucked into the compressor 4. The discharge pressure sensor 12 is provided at the discharge side of the compressor 4 and measures the pressure of the refrigerant discharged from the compressor 4. The controller 10 has a microcomputer (not shown) that controls operation of the air-conditioning apparatus 1, and a heat-generating element 10*a* that generates heat such as a power module. The heat-generating element 10*a* is, for example, a drive circuit that drives the compressor 4, and a switching element and other component included in the drive circuit generate heat. The controller 10 is housed in an electric component box, for example. The controller 10 controls operation of the compressor 4 on the basis of the pressure measured by the suction pressure sensor 11 and the pressure measured by the discharge pressure sensor 12.

Figure 2:
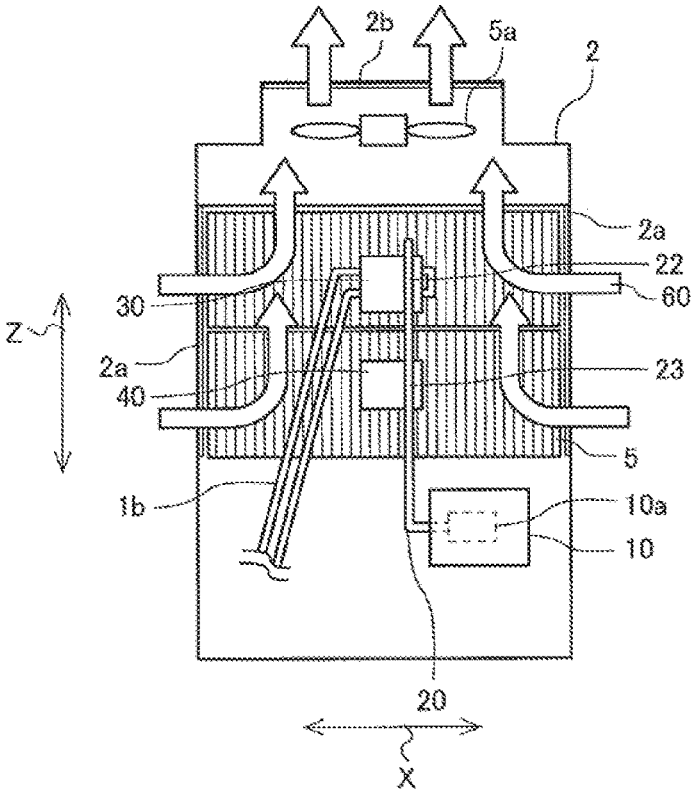
FIG. 2 is a front cross-sectional view showing an outdoor unit 2 in Embodiment 1 of the present invention.
Figure 3:
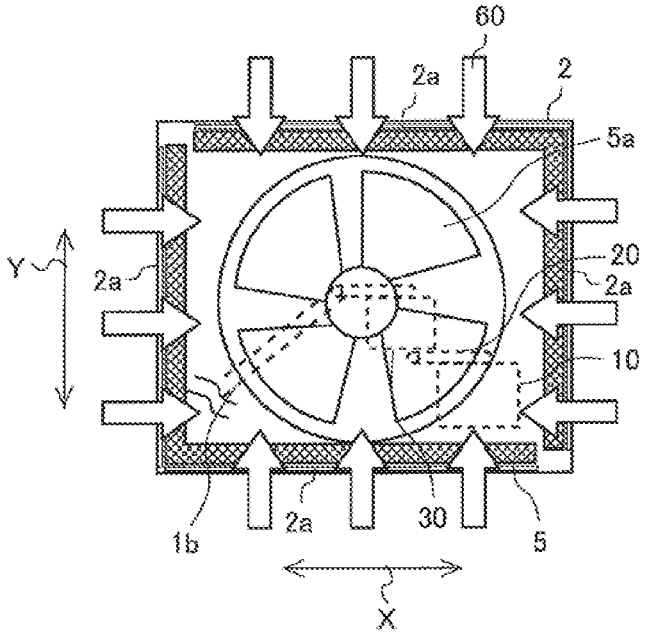
FIG. 3 is a top view showing the outdoor unit 2 in Embodiment 1 of the present invention.

FIG. 2 is a front cross-sectional view showing the outdoor unit 2 in Embodiment 1 of the present invention, and FIG. 3 is a top view showing the outdoor unit 2 in Embodiment 1 of the present invention. As shown in FIG. 2, the air-conditioning apparatus 1 further includes a heat transfer element 20 and a second cooling unit 40, and both the heat transfer element 20 and the second cooling unit 40 are provided in the outdoor unit 2. The outdoor unit 2 has a casing with a quadrangular tube shape, for example. In the outdoor unit 2, the outdoor fan 5*a* is provided at an upper portion, the controller 10 is provided at a lower portion, and the first heat exchanger 5 is disposed between the outdoor fan 5*a* and the controller 10. In addition, as shown in FIG. 3, the first heat exchanger 5 is mounted on inner walls at four sides of the outdoor unit 2. As shown in FIG. 2 and FIG. 3, air inlets 2*a* through which outdoor air 60 is sucked are formed in the four sides of the outdoor unit 2, and an air outlet 2*b* through which the outdoor air 60 is blown out is formed in an uppermost portion. The outdoor air 60 is sucked through the air inlets 2*a* into the outdoor unit 2 and subjected to heat exchange with the refrigerant in the first heat exchanger 5. The outdoor air 60 subjected to heat exchange ascends and is blown out of the outdoor unit 2 through the air outlet 2*b*.

Figure 4:
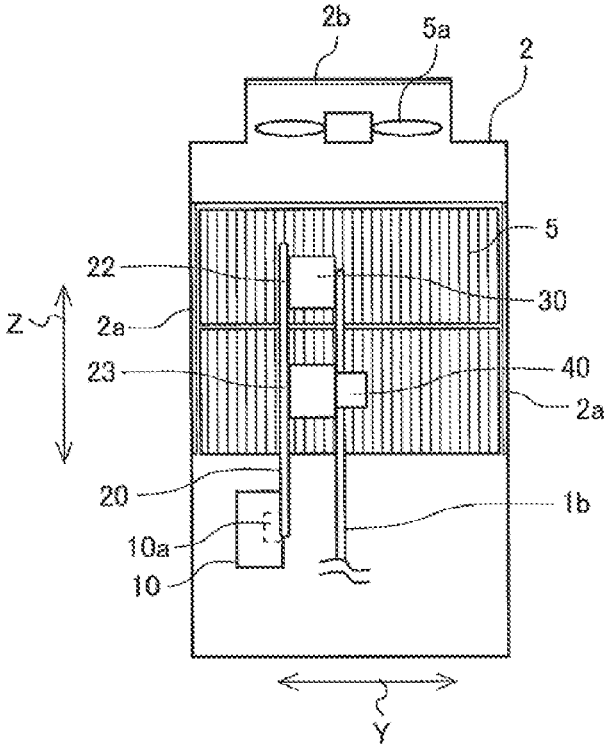
FIG. 4 is a side cross-sectional view showing the outdoor unit 2 in Embodiment 1 of the present invention.

FIG. 4 is a side cross-sectional view showing the outdoor unit 2 in Embodiment 1 of the present invention. As shown in FIG. 2 and FIG. 4, the heat-generating element 10*a* of the controller 10 is connected to a proximal end of the heat transfer element 20, and the heat transfer element 20 extends upward. The first cooling unit 30 is connected to a first connection portion 22 of the heat transfer element 20 at a distal end, and the second cooling unit 40 is connected to a second connection portion 23 of the heat transfer element 20 between the proximal end and the distal end. The pipe 1*b* of the refrigerant circuit 1*a* extends from the first cooling unit 30. The second cooling unit 40 is provided in an air path through which the outdoor air 60 flows.

Figure 5:
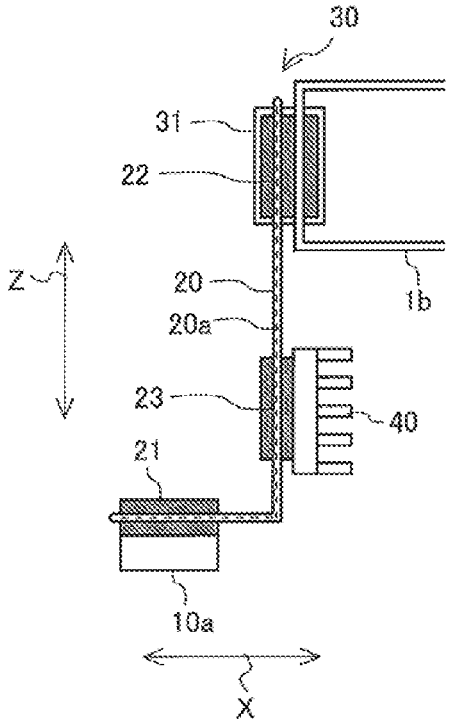
FIG. 5 is a schematic diagram showing a heat transfer element 20 in Embodiment 1 of the present invention.

FIG. 5 is a schematic diagram showing the heat transfer element 20 in Embodiment 1 of the present invention. As shown in FIG. 5, the heat-generating element 10*a* is connected to the proximal end of the heat transfer element 20, the first cooling unit 30 is connected to the distal end of the heat transfer element 20, and the heat transfer element 20 conveys heat generated by the heat-generating element 10*a*. As described above, the heat-generating element 10*a* and the heat transfer element 20 are thermally coupled to each other, and heat is transferred between the heat-generating element 10*a* and the heat transfer element 20. The heat-generating element 10*a* and the proximal end of the heat transfer element 20 are connected to each other with a metal plate 21 interposed between the heat-generating element 10*a* and the proximal end.

The second cooling unit 40 is connected between the proximal end and the distal end of the heat transfer element 20 and cools the heat transfer element 20. In Embodiment 1, the second cooling unit 40 is a heat sink having a plurality of fins. As described above, the second cooling unit 40 is provided in the air path through which the outdoor air 60 flows. With this configuration, the heat sink is cooled by the outdoor air 60 flowing through the air path, and the cooled heat sink cools the heat transfer element 20. Consequently, the heat that is generated by the heat-generating element 10*a* and conveyed to the heat transfer element 20 is rejected to the outdoor air 60. As described above, the second cooling unit 40 and the heat transfer element 20 are thermally coupled to each other, and heat is transferred between the second cooling unit 40 and the heat transfer element 20.

The first cooling unit 30 is connected to the distal end of the heat transfer element 20 and cools the heat transfer element 20 using the refrigerant. The first cooling unit 30 is covered with a heat insulating material 31 that insulates heat of the first cooling unit 30. With this configuration, the first cooling unit 30 inhibits the refrigerant flowing through the pipe 1*b* from being subjected to heat exchange with air. The heat that is generated by the heat-generating element 10*a* and conveyed to the heat transfer element 20 is rejected by the first cooling unit 30 to the refrigerant flowing through the pipe 1*b*. As described above, the first cooling unit 30 and the heat transfer element 20 are thermally coupled to each other, and heat is transferred between the first cooling unit 30 and the heat transfer element 20.

Next, the heat transfer element 20 will be described in detail. The heat transfer element 20 is a tubular part having a hollow portion 20*a* in which a volatile working fluid is sealed, such as a heat pipe, and the distal end is located above the proximal end. The heat transfer element 20 is heated at one end and cooled at the other end so that a cycle is generated in which the working fluid is evaporated and condensed to transfer heat. In Embodiment 1, the heat transfer element 20 is heated at the proximal end, which is located at the lower end, by the heat-generating element 10*a*.

In addition, the heat transfer element 20 is cooled at the distal end, which is located at the upper end, by the first cooling unit 30, and is cooled between the proximal end and the distal end by the second cooling unit 40. With this operation, the heated working fluid at the proximal end receives heat and evaporates, and the evaporated working fluid in the gas state ascends toward the distal end. Then, the working fluid in the gas state ascending toward the distal end is first cooled and condensed by the second cooling unit 40. The working fluid condensed into a liquid state falls toward the proximal end due to gravity. The refrigerant in the gas state that has not been condensed even by being cooled by the second cooling unit 40 further ascends and reaches the first cooling unit 30. Then, the working fluid in the gas state is cooled and condensed by the first cooling unit 30. The working fluid condensed into a liquid state falls toward the proximal end due to gravity. Consequently, heat is transferred in the heat transfer element 20.

Next, operation in each operation mode of the air-conditioning apparatus 1 will be described. First, cooling operation will be described. In cooling operation, the refrigerant sucked into the compressor 4 is compressed by the compressor 4 and discharged in a high-temperature and high-pressure gas state. The refrigerant discharged in the high-temperature and high-pressure gas state from the compressor 4 flows through the flow path switching unit 9 into the first heat exchanger 5 and is subjected to heat exchange with outdoor air, sent by the outdoor fan 5*a*, to become condensed and liquefied in the first heat exchanger 5. The condensed refrigerant in the liquid state flows into the expansion unit 6 and is expanded and reduced in pressure into a two-phase gas-liquid state in the expansion unit 6. Then, the refrigerant in the two-phase gas-liquid state flows into the second heat exchanger 7 and is subjected to heat exchange with indoor air, sent by the indoor fan 7*a*, to become evaporated and gasified in the second heat exchanger 7. At this time, the indoor air is cooled and cooling is performed. The evaporated refrigerant in a gas state flows through the flow path switching unit 9 into the accumulator 8 and then flows into the first cooling unit 30. At this time, the first cooling unit 30 cools the heat transfer element 20. Then, the refrigerant is sucked into the compressor 4.

Next, heating operation will be described. In heating operation, the refrigerant sucked into the compressor 4 is compressed by the compressor 4 and discharged in a high-temperature and high-pressure gas state. The refrigerant discharged in the high-temperature and high-pressure gas state from the compressor 4 flows through the flow path switching unit 9 into the second heat exchanger 7 and is subjected to heat exchange with indoor air, sent by the indoor fan 7*a*, to become condensed and liquefied in the second heat exchanger 7. At this time, the indoor air is heated, and heating is performed. The condensed refrigerant in a liquid state flows into the expansion unit 6 and is expanded and reduced in pressure into a two-phase gas-liquid state in the expansion unit 6. Then, the refrigerant in the two-phase gas-liquid state flows into the first heat exchanger 5 and is subjected to heat exchange with outdoor air, sent by the outdoor fan 5*a*, to become evaporated and gasified in the first heat exchanger 5. The evaporated refrigerant in a gas state flows through the flow path switching unit 9 into the accumulator 8 and then flows into the first cooling unit 30. At this time, the first cooling unit 30 cools the heat transfer element 20. Then, the refrigerant is sucked into the compressor 4.

Figure 6:
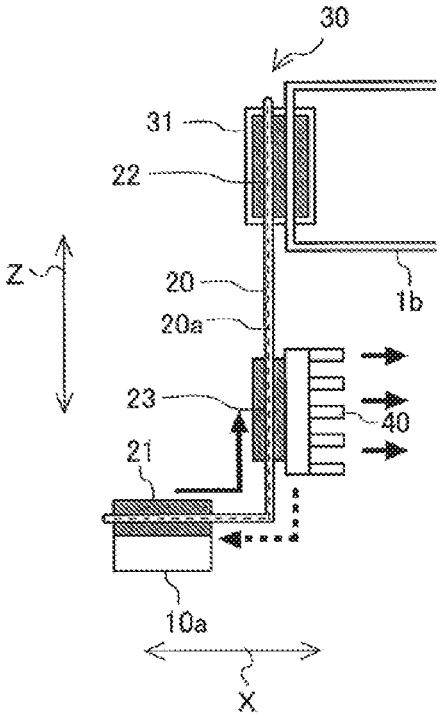
FIG. 6 is a schematic diagram showing movement of heat in the heat transfer element 20 in Embodiment 1 of the present invention.

FIG. 6 is a schematic diagram showing movement of heat in the heat transfer element 20 in Embodiment 1 of the present invention. Next, movement of heat in the heat transfer element 20 will be described. First, the case where an amount of heat generated from the heat-generating element 10*a* is small will be described. As shown in FIG. 6, heat conveyed from the heat-generating element 10*a* is absorbed by the working fluid at the proximal end of the heat transfer element 20 and ascends together with the evaporated working fluid in the hollow portion 20*a* of the heat transfer element 20 (a solid arrow). The heat having ascended is absorbed by the second cooling unit 40 and rejected to the interior of the outdoor unit 2. With this operation, the condensed working fluid falls (a broken arrow), and the heat-generating element 10*a* is cooled. The heat having ascended is absorbed by the second cooling unit 40 and thus does not further ascend in the hollow portion 20*a* of the heat transfer element 20.

Figure 7:
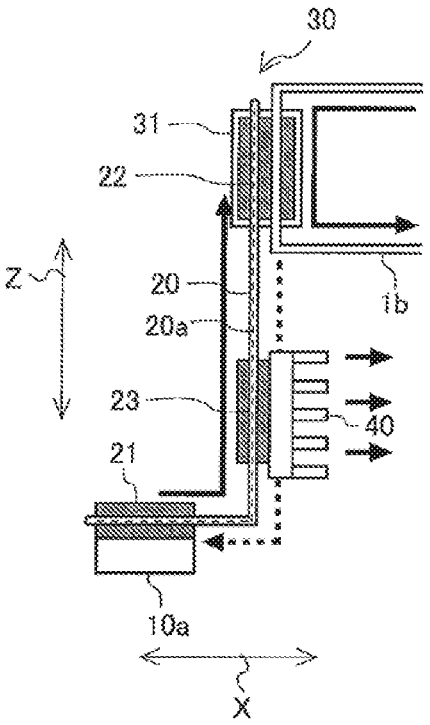
FIG. 7 is another schematic diagram showing movement of heat in the heat transfer element 20 in Embodiment 1 of the present invention.

FIG. 7 is another schematic diagram showing movement of heat in the heat transfer element 20 in Embodiment 1 of the present invention. Next, the case where an amount of heat generated from the heat-generating element 10*a* is large will be described. As shown in FIG. 7, heat conveyed from the heat-generating element 10*a* is absorbed by the working fluid at the proximal end of the heat transfer element 20 and ascends together with the heated and evaporated working fluid in the hollow portion 20*a* of the heat transfer element 20 (a solid arrow). Part of the heat having ascended is absorbed by the second cooling unit 40 and rejected to the interior of the outdoor unit 2. At this point, part of the condensed working fluid falls (a broken arrow). The heat that has not been absorbed by the second cooling unit 40 further ascends together with the working fluid in the hollow portion 20*a* of the heat transfer element 20 (a solid arrow). Then, the heat is absorbed by the first cooling unit 30 and rejected to the refrigerant flowing through the pipe 1*b*. With this operation, the condensed working fluid falls (a broken arrow), and the heat-generating element 10*a* is cooled.

According to Embodiment 1, the heat transfer element 20 that conveys the heat generated by the heat-generating element 10*a* is cooled by the second cooling unit 40 earlier than by the first cooling unit 30 that cools heat using the refrigerant. In the case where the amount of heat generated from the heat-generating element 10*a* is small, it is possible to reject heat only with the second cooling unit 40. On the other hand, in the case where the amount of heat generated from the heat-generating element 10*a* is large, the heat is initially rejected at the second cooling unit 40, and then rejected at the first cooling unit 30. As described above, the load on the first cooling unit 30 for cooling the heat-generating element 10*a* is reduced. Consequently, for example, the amount of heat rejected to the refrigerant is smaller than that in an existing air-conditioning apparatus having only a refrigerant cooling unit for cooling heat using refrigerant. Thus, for example, during cooling operation, it is possible to inhibit a reduction in cooling capacity for cooling an air-conditioned space. As a result, the air-conditioning apparatus 1 is capable of rejecting heat generated by the heat-generating element 10*a*, while inhibiting a reduction in operating efficiency.

In addition, the heat transfer element 20 is a tubular part having the hollow portion 20*a* in which the working fluid is sealed, and the distal end is located above the proximal end. In the case where the amount of heat generated from the heat-generating element 10*a* is small, the heat conveyed from the heat-generating element 10*a* is absorbed by the working fluid at the proximal end of the heat transfer element 20 and ascends together with the evaporated working fluid in the hollow portion 20*a* of the heat transfer element 20. The heat having ascended is absorbed by the second cooling unit 40 and rejected. As described above, in the case where the amount of heat generated from the heat-generating element 10*a* is small, it is possible to reject heat only with the second cooling unit 40. In addition, in the case where the amount of heat generated from the heat-generating element 10*a* is large, the heat is initially absorbed by the second cooling unit 40, and the heat that has not been absorbed by the second cooling unit 40 further ascends together with the working fluid in the hollow portion 20*a* of the heat transfer element 20. Then, the heat is absorbed by the first cooling unit 30 and rejected to the refrigerant flowing through the pipe 1*b*. As described above, the load on the first cooling unit 30 for cooling the heat-generating element 10*a* is reduced.

In Embodiment 1, the case where the heat transfer element 20 is a heat pipe has been illustrated, but the heat transfer element 20 is not limited to a heat pipe, and may be a metal plate or other part, for example. The heat transfer element 20 only needs to be configured in such a manner that heat generated by the heat-generating element 10*a* is conveyed in order of the second cooling unit 40 and the first cooling unit 30. In addition, in Embodiment 1, the case where the distal end of the heat transfer element 20 is located above the proximal end has been illustrated, but the heat transfer element 20 is not limited to the configuration of the case, and only needs to be configured in such a manner that heat generated from the heat-generating element 10*a* is conveyed to the second cooling unit 40 earlier than to the first cooling unit 30.

Moreover, the heat insulating material 31 that is provided to the first cooling unit 30 and insulates heat of the first cooling unit 30 is further included. With this configuration, the first cooling unit 30 inhibits the refrigerant flowing through the pipe 1*b* from exchanging heat with air.

Furthermore, the first cooling unit 30 is provided at the suction side of the compressor 4. The low-temperature refrigerant in a gas state flows at the suction side of the compressor 4. With this configuration, a temperature difference is likely to be created between the heat transfer element 20 and the refrigerant. Thus, the cooling capacity of the first cooling unit 30 improves.

In an existing air-conditioning apparatus that employs a refrigerant cooling system, the temperature of a heat-generating element is about 85° C., and the temperature of refrigerant at the suction side of a compressor is about 10° C. As described above, a temperature difference of 75° C. is created between the temperatures of the heat-generating element and the refrigerant. Thus, when the heat-generating element is to be cooled by the refrigerant at the suction side of the compressor, dew condensation may occur in a controller having the heat-generating element. When dew condensation occurs in the controller, the dew condensation water may adhere to a charge unit provided in the controller, causing a problem. In the existing air-conditioning apparatus, a cooling unit using the refrigerant is installed at a portion where the relatively-high-temperature refrigerant in a gas state flows, such as between a condenser and an expansion unit so that the temperature difference between the temperatures of the heat-generating element and the refrigerant is reduced and dew condensation is avoided. However, as the temperature difference between the temperatures of the heat-generating element and the refrigerant is small, the heat rejection performance is inferior, accordingly. In addition, the necessity to adjust the temperature of the refrigerant arises, and thus the cost is increased.

On the other hand, in Embodiment 1, the first cooling unit 30 is away from the heat-generating element 10*a*. Thus, even when the first cooling unit 30 is provided at the suction side of the compressor 4, dew condensation that may be generated by the first cooling unit 30 does not occur in the controller 10 having the heat-generating element 10*a*. Thus, the influence of dew condensation on the controller 10 is very small, and it is unnecessary to adjust the temperature of the refrigerant, so that it is possible to reduce the cost.

Furthermore, the second cooling unit 40 is described as a heat sink. With this configuration, heat conveyed to the heat transfer element 20 is rejected to the air. The second cooling unit 40 may also be a Peltier element that applies a current to a joint portion of two types of metals and moves heat from one metal to another metal. As described above, the second cooling unit 40 is not limited to a heat sink, and only needs to be configured with a cooling system other than a refrigerant cooling system. In addition, the second cooling unit 40 may be a combination of a heat sink and a Peltier element. As described above, as long as the second cooling unit 40 employs a cooling system other than a refrigerant cooling system, the number of components may be any number, and the types of components may be any types.

The heat-generating element 10*a* may be a power module for which SiC is used. With this configuration, the controller 10 having the heat-generating element 10*a* is capable of operating at high temperature. Such a heat-generating element 10*a* is effective even for the case where the amount of heat generated by the heat-generating element 10*a* is large and the amount of heat rejected to the refrigerant is reduced due to an insufficient amount of the refrigerant sealed in the pipe 1*b*.

Embodiment 2

Figure 8:
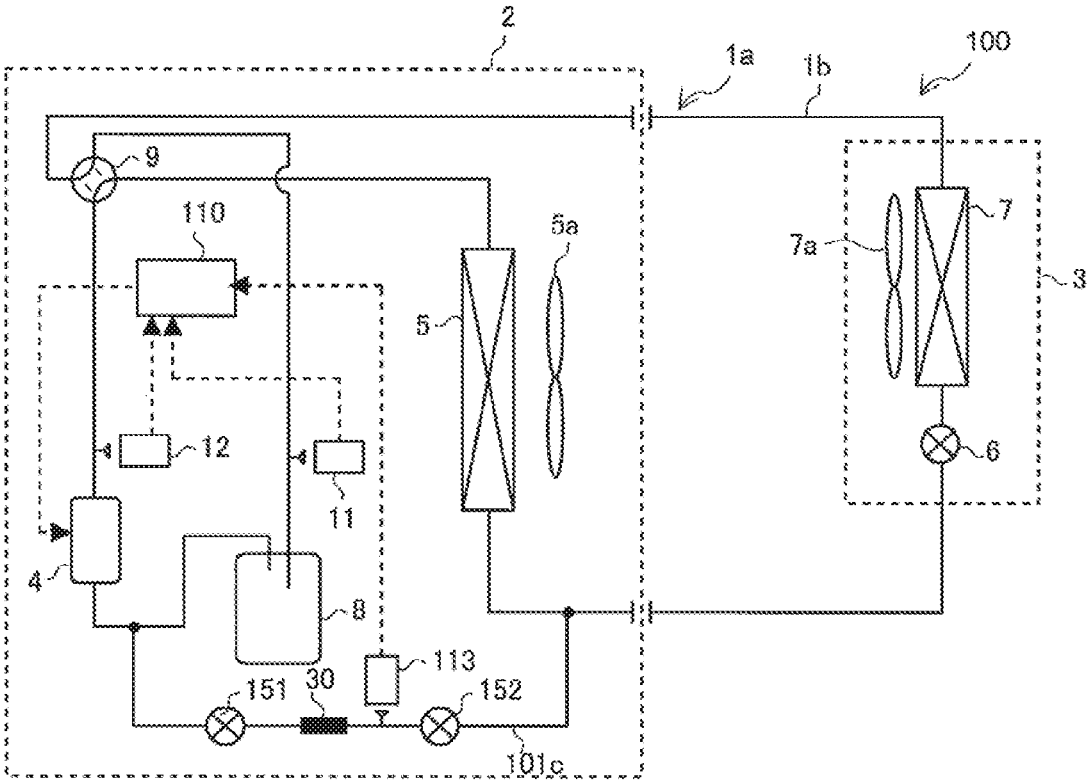
FIG. 8 is a circuit diagram showing an air-conditioning apparatus 100 according to Embodiment 2 of the present invention.

FIG. 8 is a circuit diagram showing an air-conditioning apparatus 100 according to Embodiment 2 of the present invention. Embodiment 2 is different from Embodiment 1 in the position at which the first cooling unit 30 is provided in the refrigerant circuit 1*a*. In Embodiment 2, the same portions as those in Embodiment 1 are denoted by the same reference signs and the description of the portions is omitted, and the differences from Embodiment 1 will be mainly described.

As shown in FIG. 8, the outdoor unit 2 of the air-conditioning apparatus 100 has a bypass circuit 101*c*, a first refrigerant flow rate adjustment unit 151, a second refrigerant flow rate adjustment unit 152, and a bypass temperature sensor 113. The bypass circuit 101*c* connects the suction side of the compressor 4 and a portion between the first heat exchanger 5 and the expansion unit 6. The first refrigerant flow rate adjustment unit 151 is provided on the bypass circuit 101*c*, adjusts the flow rate of the refrigerant flowing through the bypass circuit 101*c*, and is, for example, an electromagnetic expansion valve having an adjustable opening degree. The second refrigerant flow rate adjustment unit 152 is provided on the bypass circuit 101*c* and at the upstream of the first refrigerant flow rate adjustment unit 151, adjusts the flow rate of the refrigerant flowing through the bypass circuit 101*c*, and is, for example, an electromagnetic expansion valve having an adjustable opening degree.

The first cooling unit 30 is provided on the bypass circuit 101*c* and between the first refrigerant flow rate adjustment unit 151 and the second refrigerant flow rate adjustment unit 152. The bypass temperature sensor 113 is provided on the bypass circuit 101*c* and between the first cooling unit 30 and the second refrigerant flow rate adjustment unit 152 and measures the temperature of the refrigerant flowing through the bypass circuit 101*c*.

A controller 110 adjusts the opening degrees of the first refrigerant flow rate adjustment unit 151 and the second refrigerant flow rate adjustment unit 152 so that the temperature measured by the bypass temperature sensor 113 becomes a predetermined temperature. The predetermined temperature is between, for example, a bypass temperature upper limit threshold and a bypass temperature lower limit threshold, and is set to a temperature, such as a temperature at which dew condensation is unlikely to occur and a temperature required for cooling the heat-generating element 10*a*.

According to Embodiment 2, the bypass circuit 101*c* connecting the suction side of the compressor 4 and the portion between the first heat exchanger 5 and the expansion unit 6, the first refrigerant flow rate adjustment unit 151 and the second refrigerant flow rate adjustment unit 152 provided on the bypass circuit 101*c* and each adjusting the flow rate of the refrigerant flowing through the bypass circuit 101*c*, and the bypass temperature sensor 113 measuring the temperature of the refrigerant flowing through the bypass circuit 101*c*, are further included, the first cooling unit 30 is provided between the first refrigerant flow rate adjustment unit 151 and the second refrigerant flow rate adjustment unit 152, and the controller 110 adjusts the first refrigerant flow rate adjustment unit 151 and the second refrigerant flow rate adjustment unit 152 in such a manner that the temperature measured by the bypass temperature sensor 113 is between the bypass temperature upper limit threshold and the bypass temperature lower limit threshold. With this configuration, even in, unlike Embodiment 1, the case where it is difficult to provide the first cooling unit 30 at the suction side of the compressor 4, the same advantageous effects of Embodiment 1 are achieved.

The invention claimed is:

1. An air-conditioning apparatus, comprising:

a refrigerant circuit in which a compressor, a first heat exchanger, an expansion valve, a second heat exchanger, an accumulator, and a first heat sink having a refrigerant path are connected to each other by a pipe and through which refrigerant flows, the refrigerant path of the first heat sink having at least one end located downstream of a suction inlet of the compressor and upstream of an outlet of the accumulator;

a controller configured to control operation of the compressor and having heat-generating circuitry, which generates heat during operation;

a heat transfer body having a proximal end connected to the heat-generating circuitry and a distal end opposite from the proximal end, the distal end being connected to the first heat sink, and the heat transfer body conveying heat generated by the heat-generating circuitry; and a second heat sink connected between the proximal end and the distal end of the heat transfer body and cooling the heat transfer body, wherein the first heat sink transfers heat from the heat transfer body to the refrigerant to cool the heat transfer body.

2. The air-conditioning apparatus of claim 1, wherein the heat transfer body comprises a tubular part having a hollow portion in which a working fluid is sealed, and the distal end is located above the proximal end.

3. The air-conditioning apparatus of claim 1, further comprising a heat insulating material provided to the first heat sink and insulating heat of the first heat sink.

4. The air-conditioning apparatus of claim 1, further comprising:

a bypass circuit connecting a suction side of the compressor and a portion between the first heat exchanger and the expansion valve;

a first refrigerant flow rate adjustment valve and a second refrigerant flow rate adjustment valve provided on the bypass circuit and each adjusting a flow rate of the refrigerant flowing through the bypass circuit; and a bypass temperature sensor measuring a temperature of the refrigerant flowing through the bypass circuit, wherein the first heat sink is provided between the first refrigerant flow rate adjustment valve and the second refrigerant flow rate adjustment valve, and the controller configured to adjust the first refrigerant flow rate adjustment valve and the second refrigerant flow rate adjustment valve in such a manner that the temperature measured by the bypass temperature sensor is between a bypass temperature upper limit threshold and a bypass temperature lower limit threshold.

5. The air-conditioning apparatus of claim 1, wherein the second heat sink is configured to reject heat to air.

6. The air-conditioning apparatus of claim 1, wherein the second heat sink includes a Peltier element.

7. The air-conditioning apparatus of claim 1, wherein the first heat sink and at least two ends of the refrigerant path of the first heat sink are located downstream of the suction inlet of the compressor and upstream of the outlet of the accumulator.

8. The air-conditioning apparatus of claim 1, wherein the refrigerant path of the first heat sink has a first end and a second end, the first end is located downstream of the suction inlet of the compressor and upstream of the outlet of the accumulator, the second end is located between the first heat exchanger and the second heat exchanger, and the first heat sink is located in a bypass circuit that connects the first end of the refrigerant path to the second end of the refrigerant path, the first heat sink is located in the bypass circuit between a first expansion and a second expansion valve.

9. The air-conditioning apparatus of claim 8, wherein the controller is configured to adjust opening degrees of the first expansion valve and the second expansion valve such that a temperature measured by a bypass temperature sensor becomes a predetermined temperature, the predetermined temperature is between an upper limit threshold, which prevents dew formation and a lower limit threshold, which is a minimum temperature to cool the heat-generating circuitry of the controller.

* * * * *